US010739076B2

(12) United States Patent
Liang et al.

(10) Patent No.: US 10,739,076 B2
(45) Date of Patent: Aug. 11, 2020

(54) HEAT EXCHANGER COIL AND HEAT EXCHANGER HAVING THE SAME

(71) Applicant: SANHUA (HANGZHOU) MICRO CHANNEL HEAT EXCHANGER CO., LTD., Hangzhou (CN)

(72) Inventors: Xin Liang, Hangzhou (CN); Qiang Gao, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 184 days.

(21) Appl. No.: 16/063,125

(22) PCT Filed: Dec. 6, 2016

(86) PCT No.: PCT/CN2016/108739

§ 371 (c)(1),
(2) Date: Jun. 15, 2018

(87) PCT Pub. No.: WO2017/101714

PCT Pub. Date: Jun. 22, 2017

(65) Prior Publication Data

US 2019/0360755 A1 Nov. 28, 2019

(30) Foreign Application Priority Data

Dec. 16, 2015 (CN) ..... 2015 2 1051917 U

(51) Int. Cl.
*F28D 1/053* (2006.01)
*F28F 1/12* (2006.01)
(Continued)

(52) U.S. Cl.
CPC ..... *F28D 1/05366* (2013.01); *F28F 1/128* (2013.01); *F28F 1/325* (2013.01); *F28F 17/005* (2013.01)

(58) Field of Classification Search
CPC ..... F28F 1/128; F28F 17/00; F28F 17/005; F28F 3/027; F28D 1/0535; F28D 1/05366; F28D 2021/0064; F28D 2021/0071
See application file for complete search history.

(56) References Cited

U.S. PATENT DOCUMENTS 4,709,753 A * 12/1987 Reifel ..... F28F 1/325 165/125
5,360,060 A * 11/1994 Tanaka ..... F28F 1/325 165/151
(Continued)

FOREIGN PATENT DOCUMENTS

CN 102047064 A 5/2011
CN 103299150 A 9/2013
(Continued)

OTHER PUBLICATIONS

Communication dated Aug. 7, 2019 transmitting the extended European Search Report dated Jul. 29, 2019 for European Patent Application No. 16874771.5.
(Continued)

*Primary Examiner* — Devon Russell
(74) *Attorney, Agent, or Firm* — Howard & Howard Attorneys PLLC

(57) ABSTRACT

A heat exchanger coil and a heat exchanger having the same. The heat exchanger coil includes: a plurality of flat tubes, each flat tube having a length direction oriented along a vertical direction; and a plurality of fins, in which each fin is disposed between adjacent flat tubes and includes a plurality of fin units arranged along the length direction of the flat tube and sequentially connected into a corrugated shape, each fin unit has a windward end portion and a leeward end portion opposite to each other in a width direction of the flat tube, and at least one end portion of the
(Continued)

windward end portion and the leeward end portion of each fin unit extends beyond the plurality of flat tubes along the width direction of the flat tube and is provided with a drain hole.

15 Claims, 9 Drawing Sheets

(51) Int. Cl.
*F28F 1/32* (2006.01)
*F28F 17/00* (2006.01)

(56) References Cited

U.S. PATENT DOCUMENTS 5,975,200 A * 11/1999 Kato ..... F28F 1/325 165/151
6,357,518 B1 * 3/2002 Sugimoto ..... F28D 1/0435 165/135
6,478,079 B1 * 11/2002 Kato ..... F28F 1/32 165/151
6,889,757 B2 * 5/2005 Iwasaki ..... F28D 1/0435 165/135
2002/0189799 A1 * 12/2002 Ozaki ..... F28D 1/05366 165/152
2005/0016718 A1 * 1/2005 Papapanu ..... F28F 1/325 165/151
2007/0199686 A1 * 8/2007 Okinotani ..... F28D 1/05383 165/152
2009/0301696 A1 * 12/2009 Iwasaki ..... F28D 1/0435 165/140
2011/0139414 A1 * 6/2011 Ghosh ..... F28F 1/128 165/151
2011/0139428 A1 6/2011 Kim et al.
2011/0168373 A1 * 7/2011 Kim ..... F28F 1/325 165/181
2013/0284416 A1 * 10/2013 Jindou ..... F28F 1/325 165/181
2013/0299141 A1 * 11/2013 Jindou ..... F28D 1/05383 165/151
2013/0299153 A1 * 11/2013 Jindou ..... F28F 1/325 165/181
2015/0034289 A1 * 2/2015 Seo ..... F28F 1/12 165/173
2015/0068244 A1 * 3/2015 Lee ..... F28F 17/005 62/498
2015/0075213 A1 * 3/2015 Ishibashi ..... B23P 15/26 62/498

FOREIGN PATENT DOCUMENTS

CN 103314269 A 9/2013
CN 103403487 A 11/2013
CN 104285118 A 1/2015
CN 104764353 A 7/2015
CN 205352165 U 6/2016
JP 58217195 A * 12/1983 ..... F28F 1/126
JP H03181759 A 8/1991
JP 2004291015 A * 10/2004 ..... F28F 1/128
JP 2008107077 A 5/2008

OTHER PUBLICATIONS

International Search Report and Written Opinion of the International Searching Authority for PCT International Application No. PCT/CN2016/108739 dated Mar. 22, 2017.

* cited by examiner

HEAT EXCHANGER COIL AND HEAT EXCHANGER HAVING THE SAME

CROSS-REFERENCE TO RELATED APPLICATIONS

This application is a National Stage of International Patent Application No. PCT/CN2016/108739, filed on Dec. 6, 2016, which claims priority and benefits of Chinese Patent Application No. 201521051917.0, filed with State Intellectual Property Office on Dec. 16, 2015, the entire contents of which are incorporated herein by reference.

BACKGROUND OF THE INVENTION

1. Field of the Invention

The present disclosure relates to a technical field of heat exchange, and more particularly to a heat exchanger coil and a heat exchanger having the same.

2. Description of the Related Art

A parallel-flow heat exchanger such as a multichannel heat exchanger includes a fin, a flat tube and a header. A refrigerant flows in the flat tube and the header, and the fin exchanges heat with ambient air. When an evaporation temperature of the refrigerant is low, and the ambient air has a high humidity, there is a large temperature difference between the fin and the ambient air, which may speed up frosting and shorten a frosting cycle, and thus affect an energy efficiency ratio of a heat exchanger because a gap between flat tubes is jammed in a short time.

SUMMARY OF THE INVENTION

Embodiments of the present disclosure seek to solve at least one of the problems existing in the related art to at least some extent. The present disclosure provides a heat exchanger coil having a long frosting cycle and a high energy efficiency ratio.

The present disclosure further provides a heat exchanger having the above heat exchanger coil.

In order to achieve above objectives, a first aspect of embodiments of the present disclosure is directed toward a heat exchanger coil, including: a plurality of flat tubes, each flat tube having a length direction oriented along a vertical direction; and a plurality of fins, in which each fin is disposed between adjacent flat tubes and includes a plurality of fin units arranged along the length direction of the flat tube and connected sequentially into a corrugated shape. Each fin unit has a windward end portion and a leeward end portion opposite to each other in a width direction of the flat tube. At least one end portion of the windward end portion and the leeward end portion of each fin unit extends beyond the plurality of flat tubes along the width direction of the flat tube and is provided with a protrusion.

The heat exchanger coil according to embodiments of the present disclosure has a long frosting cycle and a high energy efficiency ratio.

A second aspect of embodiments of the present disclosure is directed toward a heat exchanger. The heat exchanger includes: a first header; a second header; and a heat exchanger coil according to the first aspect of embodiments of the present disclosure. A first end of each flat tube of the heat exchanger coil is connected to the first header, and a second end of each flat tube of the heat exchanger coil is connected to the second header.

The heat exchanger according to embodiments of the present disclosure has a long frosting cycle and a high energy efficiency ratio, because the heat exchanger is provided with the heat exchanger coil according to the first aspect of embodiments of the present disclosure.

BRIEF DESCRIPTION OF THE DRAWINGS

Other advantages of the invention will be readily appreciated as the same becomes better understood by reference to the following detailed description when considered in connection with the accompanying drawings, wherein.

Figure 1:
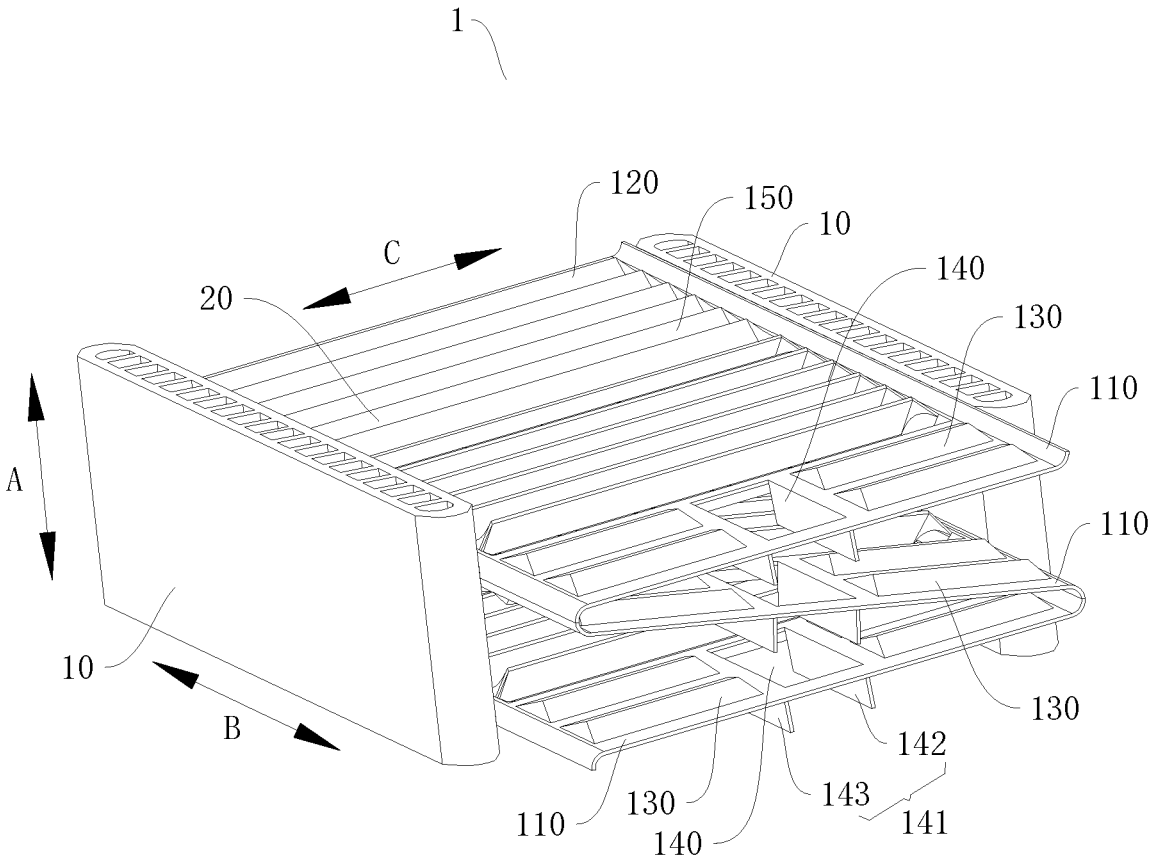
FIG. 1 is a perspective view of a heat exchanger coil according to an embodiment of the present disclosure.

REFERENCE NUMERALS heat exchanger 1;

flat tube 10; fin 20;

fin unit 100; windward end portion 110; leeward end portion 120; protrusion 130; first protrusion segment 131; second protrusion segment 132; drain hole 140; turn-up 141; first turn-up segment 142; second turn-up segment 143; louver 150; heat exchange protrusion 160.

DETAILED DESCRIPTION OF THE INVENTION

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

Referring to the drawings, a heat exchanger coil 1 according to an embodiment of the present disclosure is described below.

As show in FIG. 1 to FIG. 12, the heat exchanger coil 1 according to an embodiment of the present disclosure includes a plurality of flat tubes 10 and a plurality of fins 20.

In order for convenient understanding, the plurality of flat tubes 10 is taken as reference to describe relative positions of components. The plurality of flat tubes 10 are spaced apart from and parallel with one another, i.e., each flat tube 10 has a same orientation. A length direction of the flat tube 10 is indicated by an arrow A in the drawings, a width direction of the flat tube 10 is indicated by an arrow B in the drawings, and a thickness direction of the flat tube 10 is indicated by an arrow C in the drawings.

Specifically, the plurality of flat tubes 10 are spaced apart from and parallel with one another along the thickness direction C thereof, and the length direction of the flat tube 10 may be orientated along a vertical direction or a horizontal direction. Each fin 20 is disposed between adjacent flat tubes 10. Each fin 20 includes a plurality of fin units 100 arranged along the length direction A of the flat tube 10, and the plurality of fin units 100 may be sequentially connected together into a corrugated shape along the length direction A of the flat tube 10, so as to form a corrugated fin 20.

Each fin unit 100 has a windward end portion 110 and a leeward end portion 120, and the windward end portion 110 and the leeward end portion 120 are opposite to each other in the width direction B of the flat tube 10. It should be understood that the windward end portion 110 refers to one of two end portions of each fin unit 100, which is firstly in contact with an air flow to exchange heat with the air flow, and the leeward end portion 120 refers to the other one of the two end portions of each fin unit 100, which is in contact with the air flow to exchange heat with the air flow later. At least one of the windward end portion 110 and the leeward end portion 120 of each fin unit 100 extends beyond the plurality of flat tubes 10 along the width direction B of the flat tube 10. In other words, at least one end portion of each fin unit 100 extends beyond the plurality of flat tubes 10 along the width direction B of the flat tube 10. The at least one of the windward end portion 110 and the leeward end portion 120 of each fin unit 100 is provided with at least one of a protrusion 130 and a drain hole 140, that is a portion of each fin unit 100 extending beyond the plurality of flat tubes 10 along the width direction B thereof is provided with at least one of the protrusion 130 and the drain hole 140.

In the heat exchanger coil 1 according to an embodiment of the present discourse, since at least one of the windward end portion 110 and the leeward end portion 120 of each fin unit 100 extends beyond the plurality of flat tubes 10 along the width direction B thereof, on one hand, a heat exchange area of the plurality of fins 20 can be increased, which means a thinner layer of frost in the condition of equal frost quantity, and on the other hand, a portion of each fin unit 100 extending beyond the plurality of flat tubes 10 may lead the frost among the plurality of flat tubes 10 outwards, which may reduce a degree of the plurality of fins 20 being jammed by frost, prolong a frosting cycle and thus improve an energy efficiency ratio of the heat exchanger coil 1.

Further, the portion of each fin unit 100 extending beyond the plurality of flat tubes 10 is provided with at least one of the protrusion 130 and the drain hole 140. The protrusion 130 can improve air agitation to increase the heat exchange efficiency, and the drain hole 140 can facilitate discharge of the melted frost while defrosting.

Figure 12:
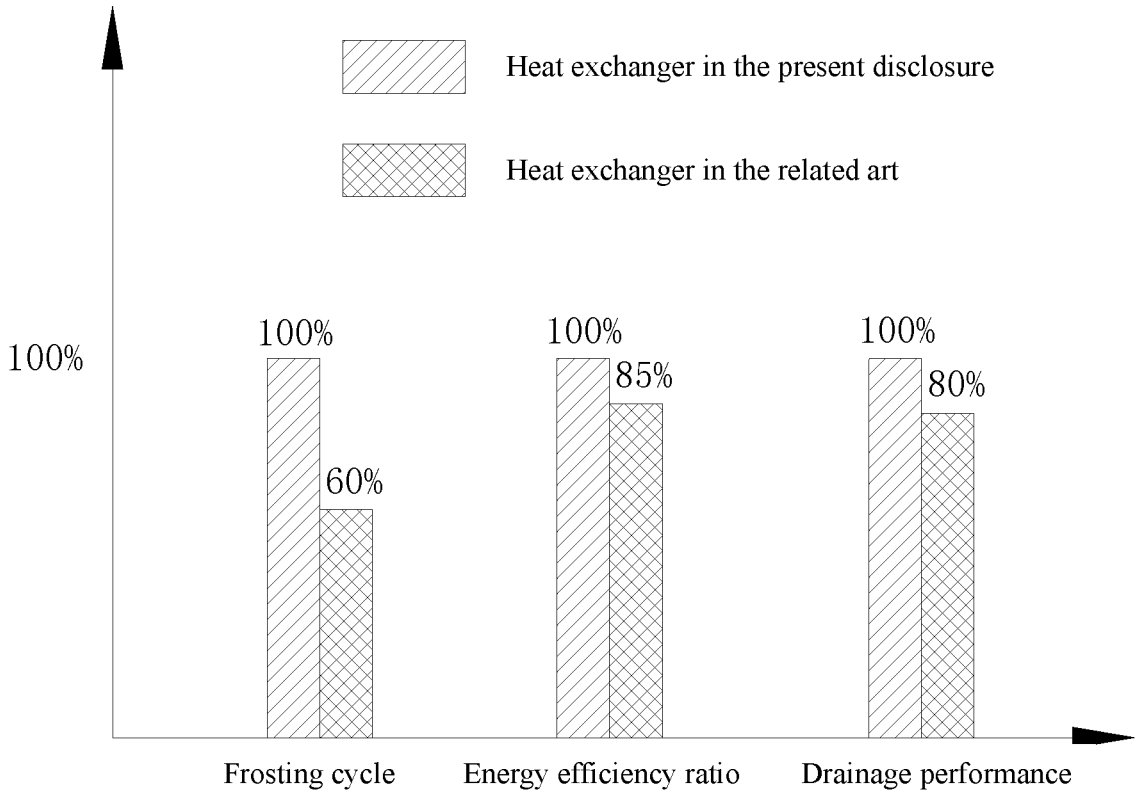
FIG. 12 is a diagram showing a performance of a heat exchanger coil according to an embodiment of the present disclosure, in comparison with that of a prior heat exchanger coil.

As shown in FIG. 12, the applicant has compared various properties of the heat exchanger coil 1 according to the embodiment of the present disclosure with various properties of a prior heat exchanger coil by experiments. According to experimental results, the heat exchanger coil 1 according to the embodiment of the present disclosure is better than the prior heat exchanger coil in properties such as a frosting cycle, an energy efficiency ratio, a drainage performance and the like.

Accordingly, the heat exchanger coil 1 according to the embodiment of the present disclosure has advantages of a long frosting cycle and a high energy efficiency ratio.

Referring to the drawings, the heat exchanger coil 1 according to specific embodiments of the present disclosure is described in the flowing. As show in FIG. 1 to FIG. 12, the heat exchanger coil 1 according to embodiments of the present disclosure includes the plurality of flat tubes 10 and the plurality of fins 20.

Specifically, as shown in FIG. 1 to FIG. 11, the windward end portion 110 of each fin unit 100 extends beyond the plurality of flat tubes 10 along the width direction B of the flat tube 10. When the heat exchanger coil 1 is working, the windward end portion 110 of each fin unit 100 is firstly in contact with the air flow, so the windward end portion 110 of each fin unit 100 has a large temperature difference and thus is easiest to be frosted. The windward end portion 110 of each fin unit 100 extends beyond the plurality of flat tubes 10, so as to reduce a thickness of frost on the windward end portion 110 and lead the frost on the windward end portion 11 out of the plurality of flat tubes 10, thus preventing the fin jam and ensuring the energy efficiency ratio of the heat exchanger coil 1.

Figure 2:
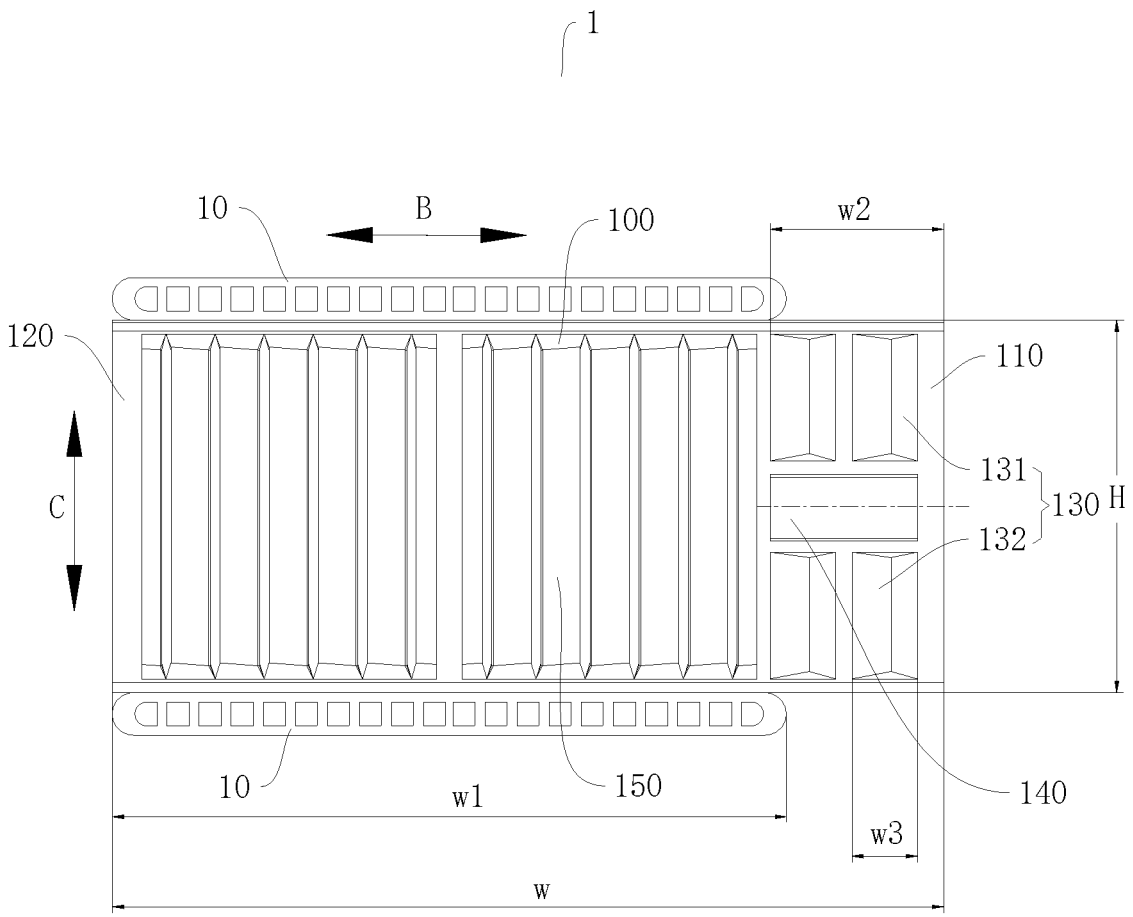
FIG. 2 is a schematic view of a heat exchanger coil according to an embodiment of the present disclosure.

Optionally, as shown in FIG. 2, a length of each of the at least one of the windward end portion 110 and the leeward end portion 120 of each fin unit 100, which extends beyond the plurality of flat tubes 10 along the width direction B of the flat tube 10, is represented by w2, and a width of each flat tube 10 is represented by w1, in which $0.05 \leq w2/w1 \leq 1.0$. Preferably, $0.2 \leq w2/w1 \leq 0.5$. Therefore, it can be guaranteed that more than 1% of the frost can be leaded out of the plurality of flat tubes 10, such that internal frost can be shared and a distance between the end portion of each fin unit 100 beyond the plurality of flat tubes 10 and the plurality of the flat tubes 10 can be guaranteed, thus facilitating heat transfer from the plurality of flat tubes 10 to the end portion of each fin unit 100 beyond the plurality of flat tubes 10.

FIG. 1 and FIG. 2 show a heat exchanger coil 1 according to some specific embodiments of the present disclosure. As shown in FIG. 1 and FIG. 2, a portion of each fin unit 100, which does not extend beyond the plurality of flat tubes 10 along the width direction B of the flat tube 10, is provided with a louver 150, and the portion of each fin unit 100 extending beyond the plurality of flat tubes 10 along the width direction B of the flat tube 10 is provided with both the protrusion 130 and the drain hole 140 at the same time.

FIG. 1 and FIG. 2 show an example in which the windward end portion 110 of each fin unit 100 is provided with both the protrusion 130 and the drain hole 140 at the same time.

Air firstly flows through the protrusion 130 on the windward end portion 110 and then flows to the louver 150. Because the windward end portion 110 extends beyond the plurality of flat tubes 10, the temperature thereat is not too low. Moreover, as a heat exchange efficiency of the protrusion 130 is lower than that of the louver 150, the air will not be quickly frosted but only loses some moisture when encountering cold while flowing through the protrusion 130, and moisture at the windward end portion 110 can be easily drained so as to achieve dehumidification. The air after dehumidification flows through the louver 150, and the frost on the louver 150 can be effectively reduced because the air has less moisture. Furthermore, the moisture at the protrusion 130 can be conveniently drained, and thus the frost on the windward end portion 110 is reduced. Therefore, the frost among the plurality of flat tubes 10 can be leaded out of the plurality of flat tubes 10 to prolong a cycle of the plurality of fins 20 being jammed by frost. Providing the drain hole 140 may facilitate drainage of the melted frost on the portion of each fin unit 100 extending beyond the plurality of flat tubes 10.

Specifically, as shown in FIG. 2, the drain hole 140 is a rectangular hole whose length direction extends along the width direction B of the flat tube 10, each fin unit 100 is provided with a plurality of protrusions 130 arranged along the width direction B of the flat tube 10, and each protrusion 130 extends along the thickness direction C of the flat tube 10 and includes a first protrusion segment 131 and a second protrusion segment 132 spaced apart from each other along the thickness direction C of the flat tube 10. The drain hole 140 is located in a center of each fin unit 100 and between the first protrusion segment 131 and the second protrusion segment 132 in the thickness direction C of the flat tube 10.

Each protrusion 130 may be in a shape of a triangular prism extending along the thickness direction C of the flat tube 10, to improve the air agitation and facilitate drainage, and adjacent protrusions 130 are spaced apart from or connected with each other along the width direction B of the flat tube 10.

Optionally, as shown in FIG. 2, a length of each of the at least one of the windward end portion and the leeward end portion of each fin unit 100 along the width direction B of the flat tube 10 is represented by w2, and a maximum width of each protrusion 130 along the width direction B of the flat tube 10 is represented by w3, and $0.05 \leq w3/w2 \leq 1$. Preferably, $0.2 \leq w3/w2 = 0.45$. Thus, it is convenient to mold the protrusion 130 by pressing, and the protrusion 130 contributes to the air agitation.

Furthermore, as shown in FIG. 2, a length of each fin unit 100 along the width direction B of the flat tube 10 is represented by w, and $w \leq w1 + w2 \leq 1.1\ w$, i.e., each protrusion 130 may go deep into a position among the plurality of flat tubes 10. Because the protrusion 130 has no window, a heat transfer path between the portion of each fin unit 100 extending beyond the plurality of flat tubes 10 and the plurality of flat tubes 10 is broadened, to improve a heat exchange efficiency of the portion of each fin unit 100 extending beyond the plurality of the flat tubes 10.

Advantageously, as shown in FIG. 1, each flat tube 10 has an upper end and a lower end in the length direction thereof, i.e., the length direction A of the flat tube 10 is oriented along a vertical direction. Drain holes 140 of the plurality of fin units 100 are aligned with one another along the length direction A of the flat tube 10, and each drain hole 140 may be a turn-up hole having a turn-up 141. The turn-up 141 of each drain hole 140 extends from the fin unit 100 where the drain hole 140 is towards the lower ends of the plurality of flat tubes 10, i.e., substantially from top down. Accordingly, the drain holes 140 of the plurality of fin units 100 and the turn-ups 141 thereof form a drain channel to facilitate drainage.

Further, as shown in FIG. 1, each drain hole 140 may be a rectangular hole, the turn-up 141 of each drain hole 140 includes a first turn-up segment 142 and a second turn-up segment 143 spaced apart from each other along the thickness direction C of the flat tube 10 and extending along the width direction B of the flat tube 10, that is the turn-up 141 is opened at two sides of the width direction B of the flat tube 10. Accordingly, the turn-up 141 is parallel to the air flow, so as to reduce air resistance.

Figure 3:
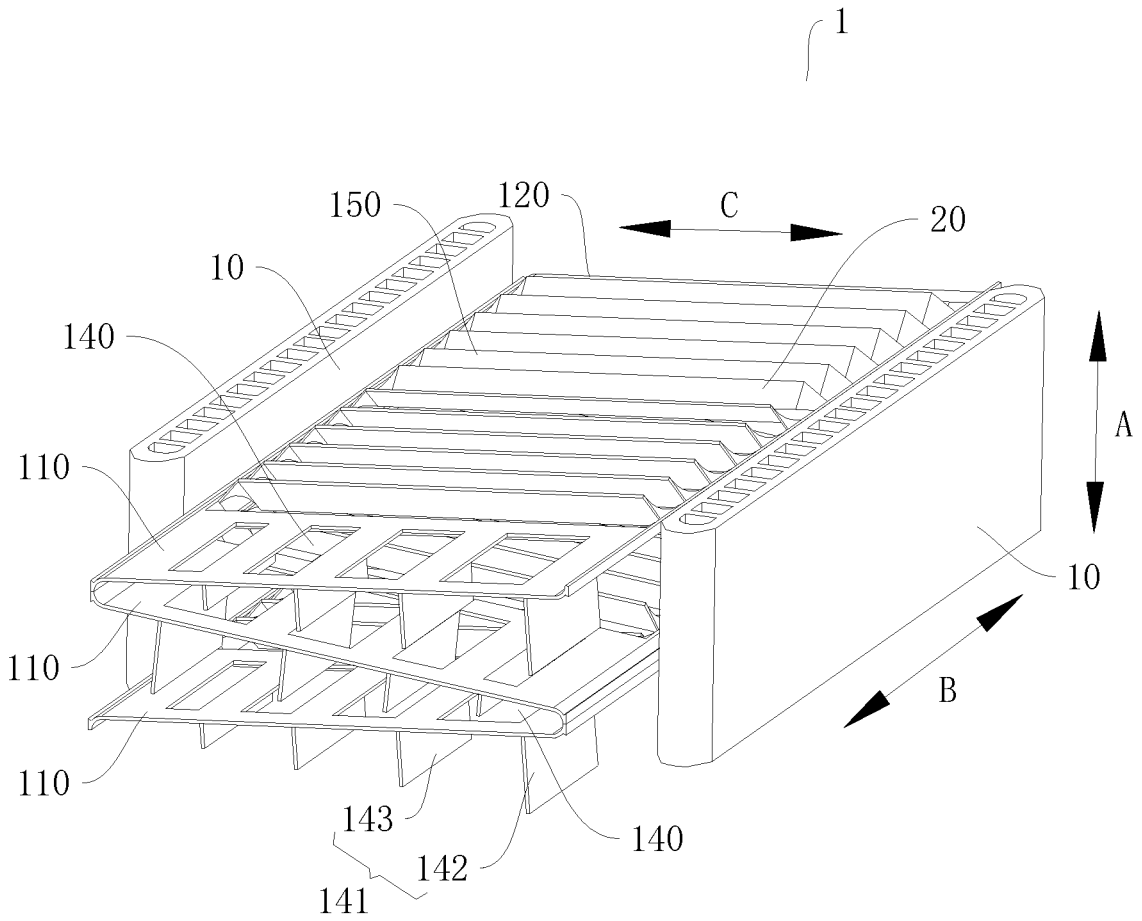
FIG. 3 is a perspective view of a heat exchanger coil according to a first optional embodiment of the present disclosure.
Figure 4:
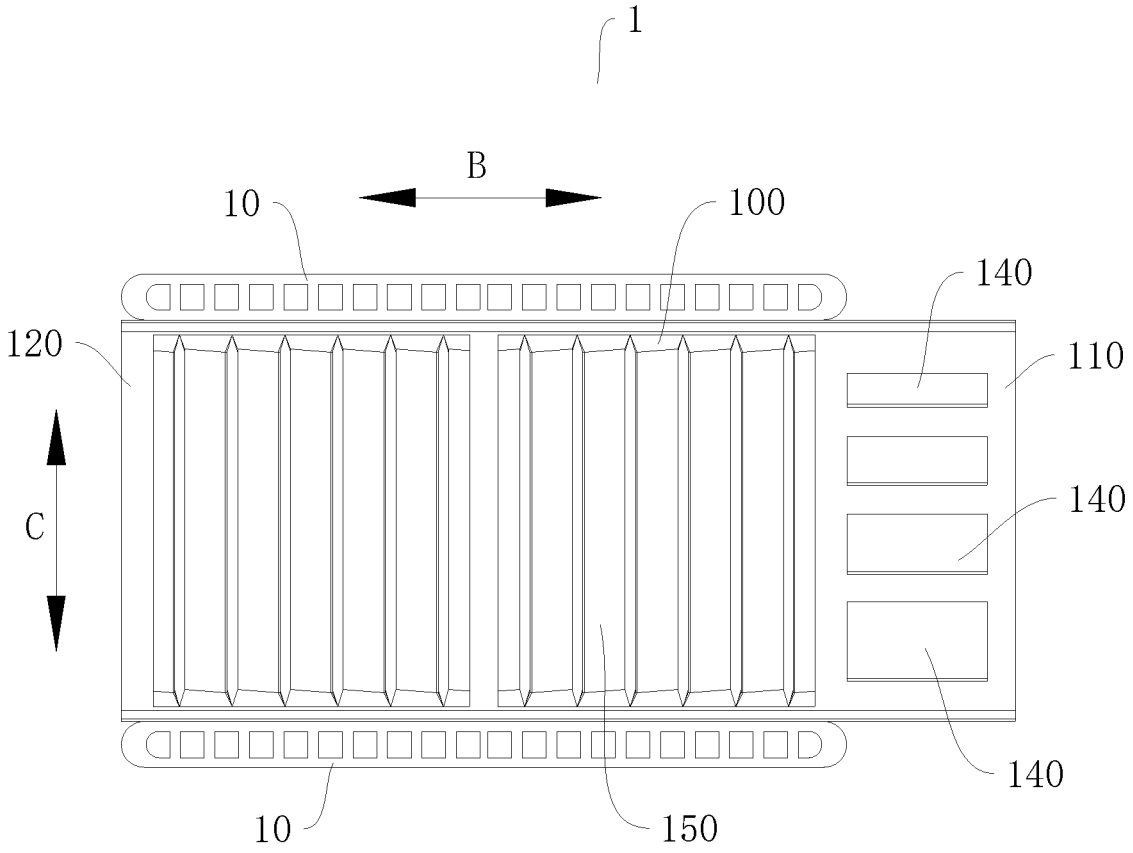
FIG. 4 is a schematic view of the heat exchanger coil according to the first optional embodiment of the present disclosure.

FIG. 3 and FIG. 4 show a heat exchanger coil 1 according to a specific embodiment of the present disclosure. As shown in FIG. 3 and FIG. 4, a portion of each fin unit 100, which does not extend beyond the plurality of flat tubes 10 along the width direction B of the flat tube 10, is provided with a louver 150, and a portion of each fin unit 100 extending beyond the plurality of flat tubes 10 along the width direction B of the flat tube 10 is provided with only the drain hole 140.

Specifically, as shown in FIG. 3, each flat tube 10 has an upper end and a lower end in the length direction thereof, i.e., the length direction A of the flat tube 10 is oriented along a vertical direction. Drain holes 140 of the plurality of fin units 100 are aligned with one another along the length direction A of the flat tube 10, and each drain hole 140 may be a turn-up hole having a turn-up 141, and the turn-up 141 of each drain hole 140 extends from the fin unit 100 where the drain hole 140 is towards the lower ends of the plurality of flat tubes 10. Accordingly, the drain holes 140 of the plurality of fin plurality of fin units 100" and the turn-ups 141 thereof form a drain channel to facilitate drainage.

Further, as shown in FIG. 3 and FIG. 4, each drain hole 140 may be a rectangular hole, the turn-up 141 of each drain hole 140 includes a first turn-up segment 142 and a second turn-up segment 143 spaced apart from each other along the thickness direction C of the flat tube 10 and extending along the width direction B of the flat tube 10, that is the turn-up 141 is opened at two sides of the width direction B of the flat tube 10. Accordingly, the turn-up 141 is parallel to the air flow, so as to reduce air resistance.

Optionally, as shown in FIG. 4, each fin unit 100 is provided with a plurality of drain holes 140, the plurality of drain holes 140 are spaced apart from one another along the thickness direction C of flat tube 10, and each drain hole 140 may be a rectangular hole extending along the width direction B of the flat tube 10. Widths of the plurality of drain holes 140 in each fin unit 100 gradually decrease from one of two adjacent flat tubes 10 to the other one thereof along the thickness direction C of the flat tube 10.

Figure 5:
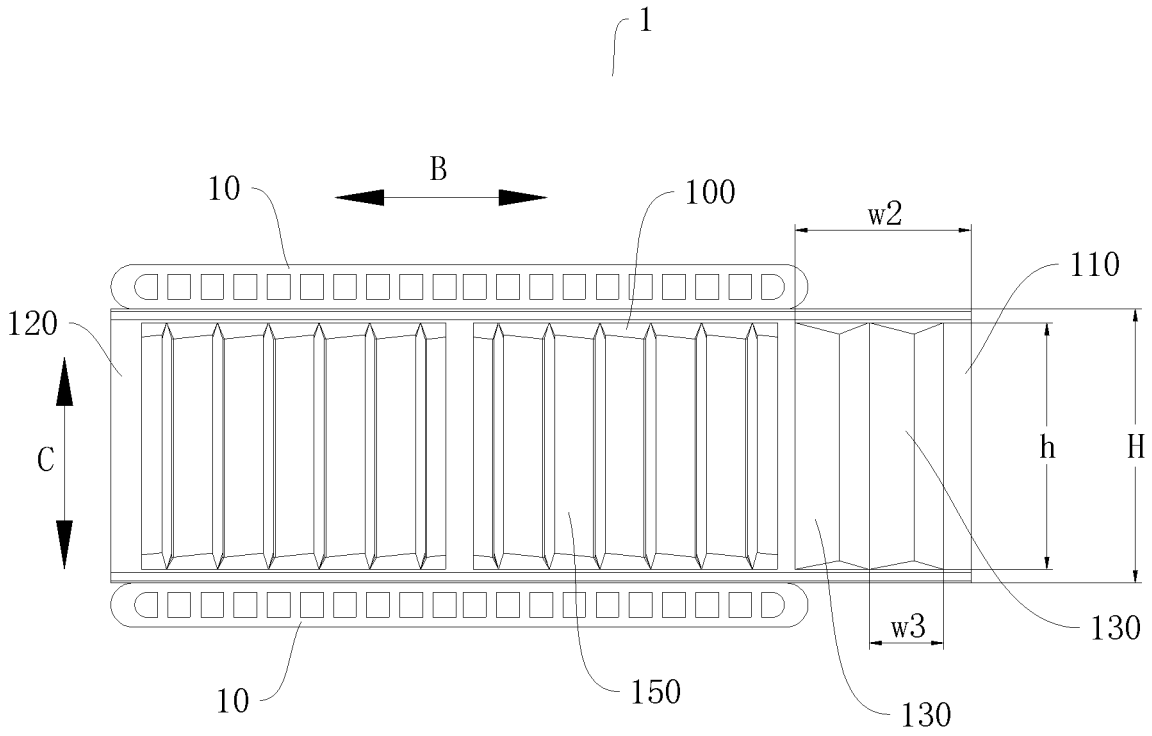
FIG. 5 is a schematic view of a heat exchanger coil according to a second optional embodiment of the present disclosure.

FIG. 5 shows a heat exchanger coil 1 according to some specific embodiments of the present disclosure. As shown in FIG. 5, a portion of each fin unit 100 which does not extend beyond the plurality of flat tubes 10 along the width direction B of the flat tube 10 is provided with a louver 150, and a portion of each fin unit 100 extending beyond the plurality of flat tubes 10 along the width direction B of the flat tube 10 is provided with only the protrusion 140.

Specifically, each fin unit 100 may be provided with a plurality of protrusions 130 arranged along the width direction B of the flat tube 10, each protrusion 130 may be in a shape of a triangular prism extending along the thickness direction C of the flat tube 10, and adjacent protrusions 130 are spaced apart from or connected with each other along the width direction B of the flat tube 10.

Air firstly flows through the protrusions 130 on the windward end portion 110 and then flows to the louver 150. Because the windward end portion 110 extends beyond the plurality of flat tubes 10, the temperature thereat is not too low. Moreover, as a heat exchange efficiency of the protrusions 130 is lower than that of the louver 150, the air will not be quickly frosted but only loses some moisture when encountering cold while flowing through the protrusions 130, and moisture at the windward end portion 110 can be easily drained so as to achieve dehumidification. The air after dehumidification flows through the louver 150, the frost on the louver 150 can be effectively reduced because the air has less moisture, and the moisture at the protrusions 130 can be conveniently drained to reduce frost on the windward end portion 110. Therefore, the frost among the plurality of flat tubes 10 can be leaded out of the plurality of flat tubes 10 to prolong a cycle of the plurality of fins 20 being jammed by frost.

Optionally, as shown FIG. 5, a width of each fin unit 100 along the thickness direction C of flat tube 10 is represented by H, a length of each protrusion 130 along the thickness direction C of flat tube 10 is represented by h, a length of each of the at least one of the windward end portion 110 and the leeward end portion 120 of each fin unit 100, which extends beyond the plurality of flat tubes 10 along the width direction B of the flat tube 10, is represented by w2, and the maximum width of each protrusion 130 along the width direction B of the flat tube 10 is represented by w3, in which $0.5 \leq h/H \leq 0.95$ and $0.05 \leq w3/w2 \leq 1$. Accordingly, the protrusions 130 contribute to the air agitation, and it is also convenient to mold the protrusions 130 by pressing.

Figure 6:
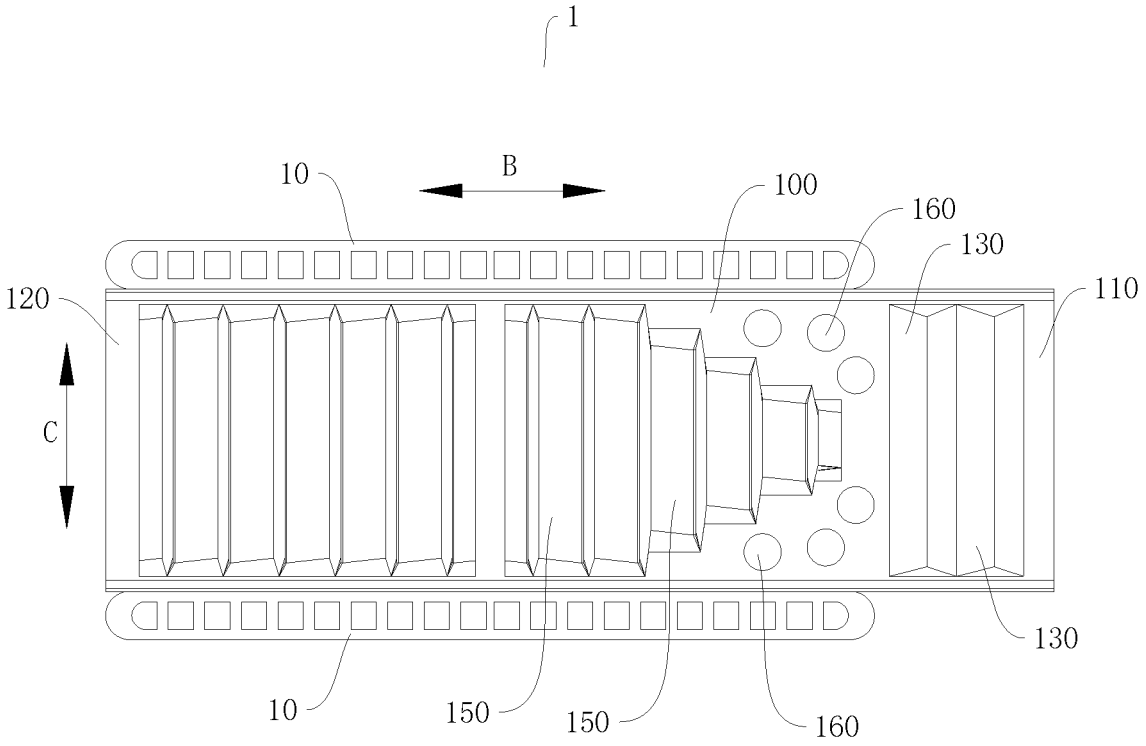
FIG. 6 is a schematic view of a heat exchanger coil according to a third optional embodiment of the present disclosure.

FIG. 6 shows a heat exchanger coil 1 according to some specific embodiments of the present disclosure. As shown in FIG. 6, the windward end portion 110 of each fin unit 100 extends beyond the plurality of flat tubes 10 and is provided with a protrusion 130, and a portion of each fin unit 100 which does not extend beyond the plurality of flat tubes 10 along the width direction B of the flat tube 10 is provided with a plurality of louvers 150. The plurality of louvers 150 is spaced part from one another along the width direction B of the flat tube 10, and lengths of the plurality of louvers 150 along the thickness direction C of the flat tube 10 gradually decrease from a middle portion of the fin unit to the windward end portion 110 of the fin unit 100. Each fin unit 100 is provided with a heat exchange protrusion 160 close to the windward end portion 110.

In other words, the closer to the windward end portion 110, the smaller the length of the louver 150. With respect to the longest louver 150, a plurality of heat exchange protrusions 160 are provided between the shorter louver 150 and the flat tube 10 adjacent to the shorter louver 150, and each heat exchange protrusion 160 may have a spherical segment shape. On one hand, a heat transfer path between the portion of each fin unit 100 extending beyond the flat tubes 10 and the flat tubes 10 is enlarged to improve a heat exchange efficiency of the portion of the fin unit 100 extending beyond the flat tubes 10, and on the other hand, the heat exchange protrusions 160 improve the air agitation and facilitate the heat exchange.

Figure 7:
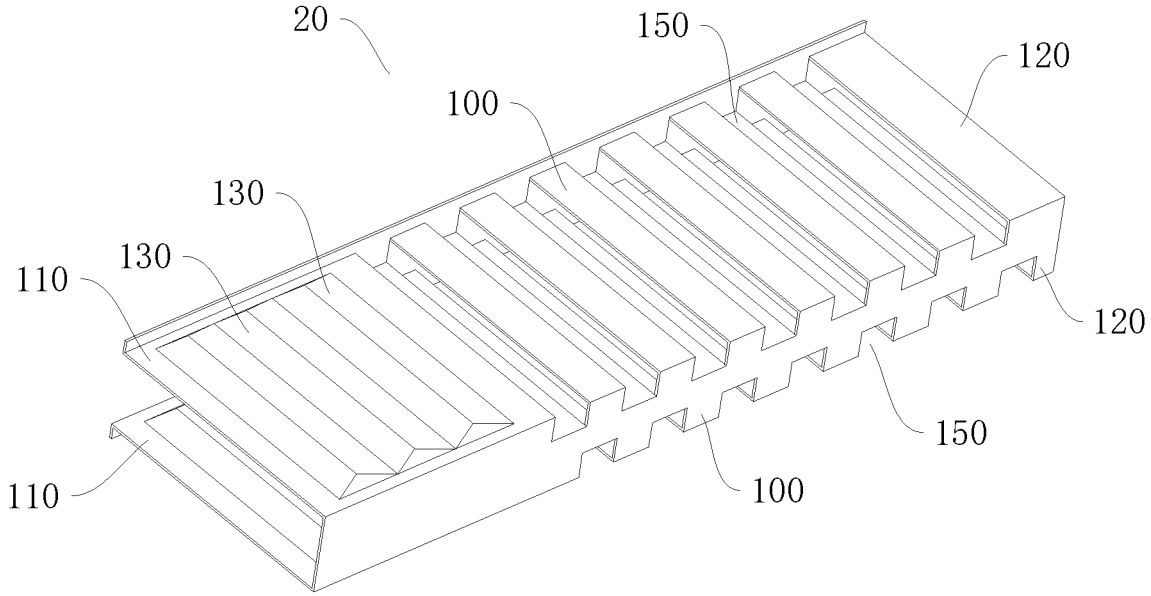
FIG. 7 is a schematic view of a fin of a heat exchanger coil according to a fourth optional embodiment of the present disclosure.
Figure 8:
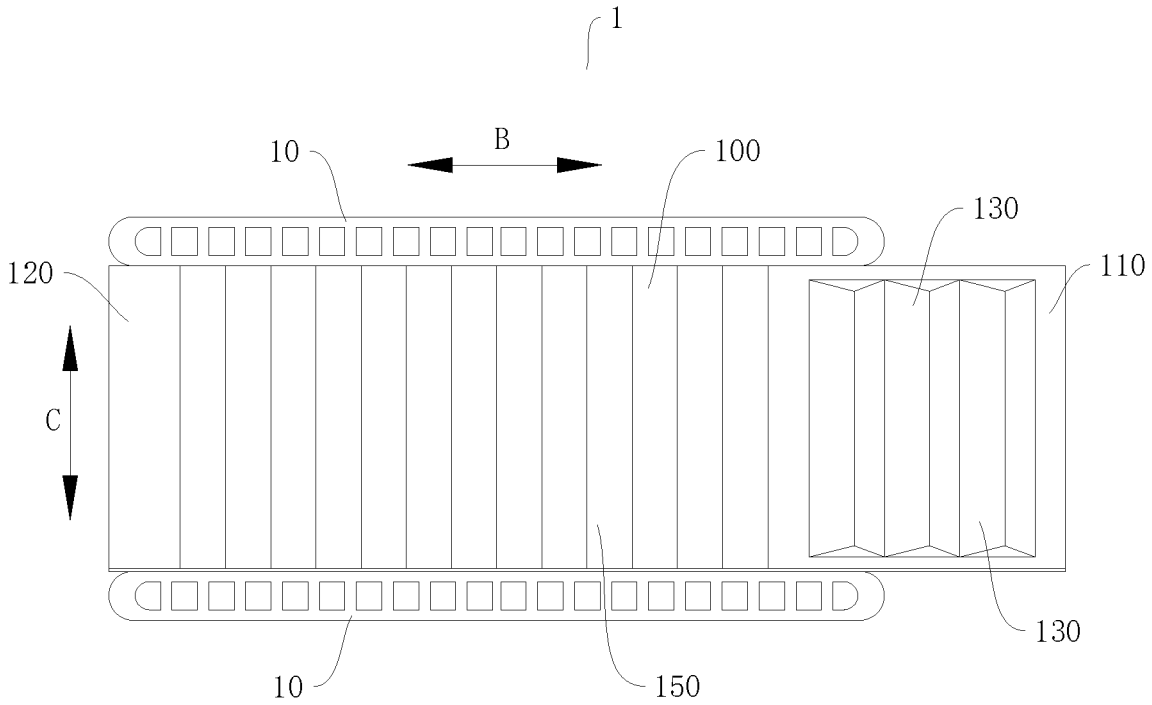
FIG. 8 is a schematic view of the heat exchanger coil according to the fourth optional embodiment of the present disclosure.

FIG. 7 and FIG. 8 show a heat exchanger coil 1 according to some specific embodiments of the present disclosure. As shown in FIG. 7 and FIG. 8, the windward end portion 110 of each fin unit 100 extends beyond the plurality of flat tubes 10 and is provided with a protrusion 130. A portion of each fin unit 100 which does not beyond the plurality of flat tubes 10 along the width direction B of the flat tube 10 is provided with a plurality of louvers 150, the plurality of louvers 150 of adjacent fin units 100 are staggered with one another along the width direction B of the flat tube 10, which facilitates drainage, and the portion of each fin unit 100 extending beyond the flat tubes 10 facilitates leading frost out of the flat tubes 10, so as to prolong a cycle of the fins 20 being jammed.

Figure 9:
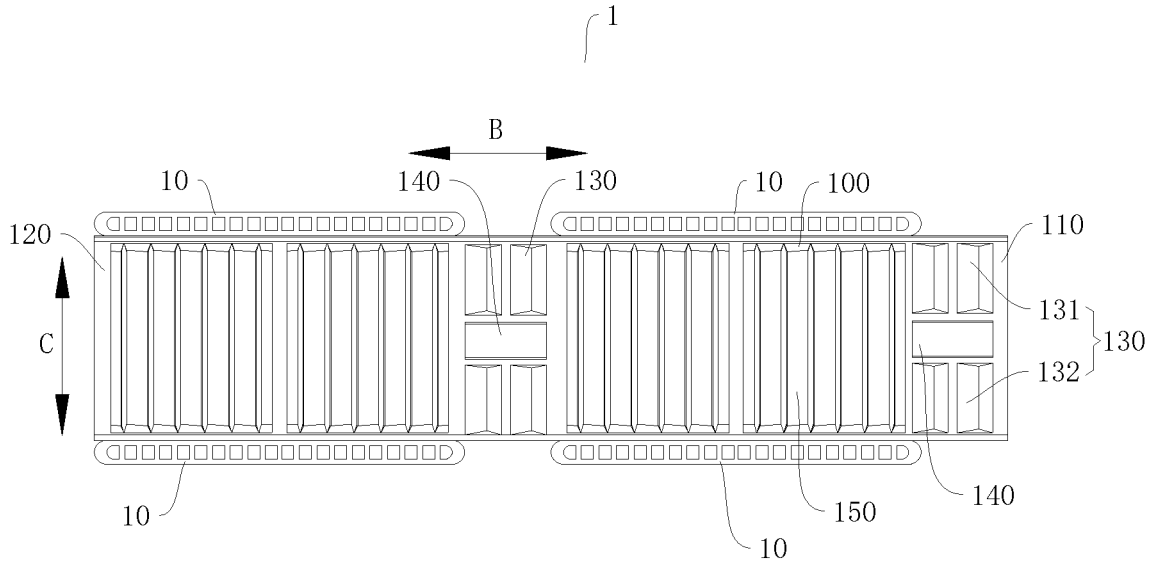
FIG. 9 is a schematic view of a heat exchanger coil according to a fifth optional embodiment of the present disclosure.
Figure 10:
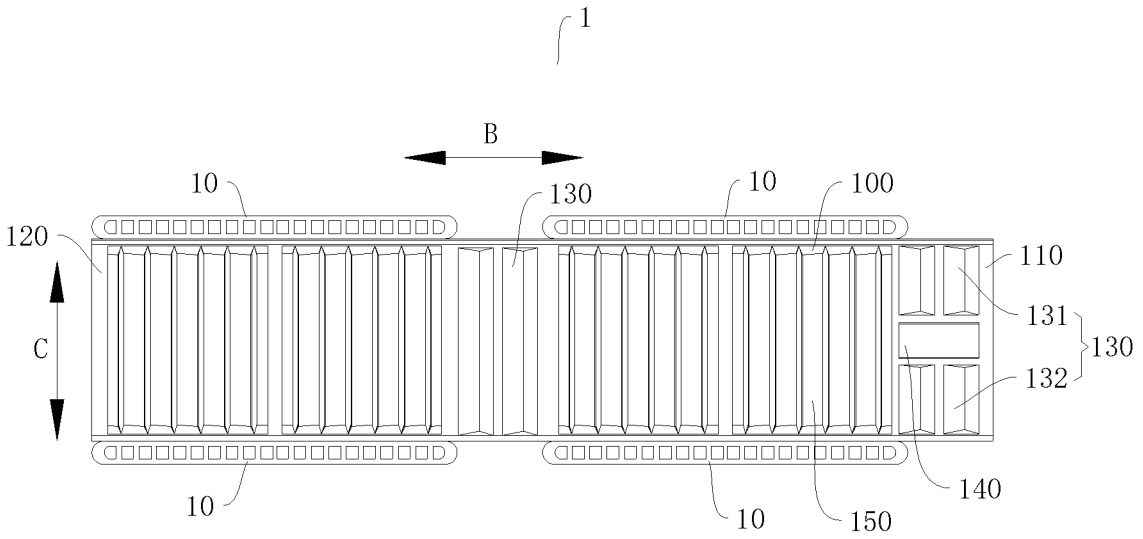
FIG. 10 is a schematic view of a heat exchanger coil according to a sixth optional embodiment of the present disclosure.
Figure 11:
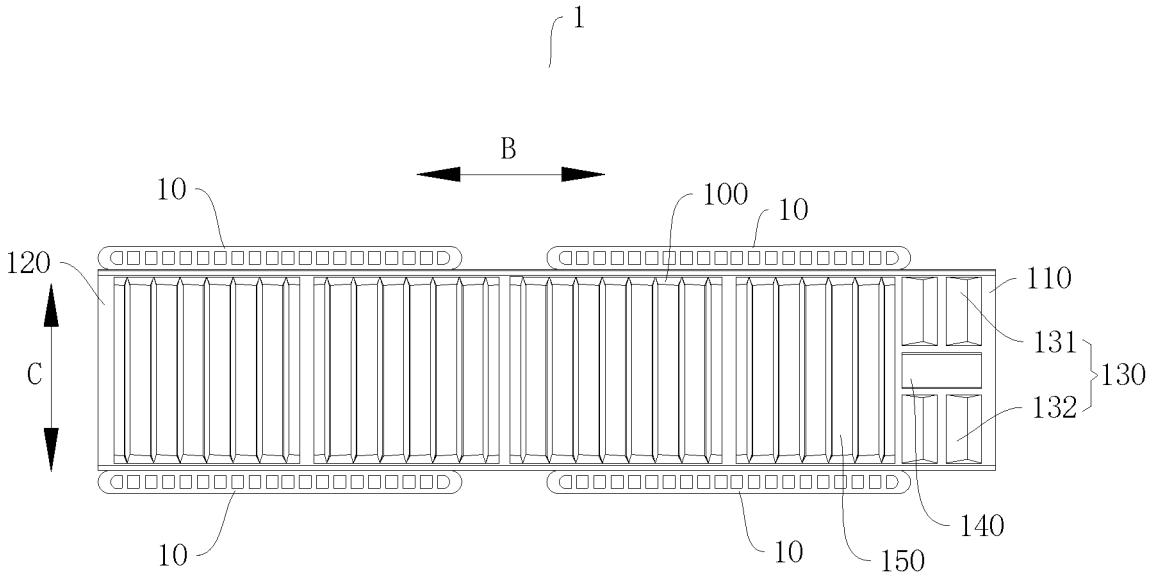
FIG. 11 is a schematic view of a heat exchanger coil according to a seventh optional embodiment of the present disclosure.

FIG. 9 to FIG. 11 show a heat exchanger coil 1 according to some specific embodiments of the present disclosure. As shown in FIG. 9 to FIG. 10, a plurality of flat tubes 10 are arranged in multiple rows spaced apart from one another along the width direction B of the flat tube 10, and the flat tubes 10 in a row correspond to the flat tubes in an adjacent row one to one, i.e., the flat tubes 10 in a row are in line with the flat tubes in an adjacent row one to one. Each fin 20 is disposed between adjacent flat tubes 10 in each row, and at least one of the windward end portion 110 and the leeward end portion 120 of each fin unit 100 extends beyond the outermost ones of corresponding flat tubes 10 (between which the fin unit 100 is located) in the multiple rows along the width direction B of the flat tube 10. In other words, the heat exchanger coil 1 has multiple rows of flat tubes 10, each fin 10 runs through the multiple rows of flat tubes 10 and is located between corresponding adjacent flat tubes 10 in each row, and at least one of the windward end portion 110 and the leeward end portion 120 of each fin unit 100 extends beyond the entire multiple rows of flat tubes 10 along the width direction B of the flat tube 10. It should be noted that multiple flat tubes 10 may be provided in each row, and only two flat tubes 10 are shown in the drawings for explanation herein.

Advantageously, each fin unit 100 is provided with at least one of the protrusion 130, the drain hole 140, the louver 150 and the heat exchange protrusion 160 at a portion thereof between adjacent rows. Of course, each fin unit 100 may not be provided with any structure at the portion thereof between the adjacent rows.

For example, as shown in FIG. 9, each fin unit 100 is provided with both the protrusion 130 and the drain hole 140 at the portion thereof between the adjacent rows. The drain hole 140 is a rectangular hole whose length direction extends along the width direction B of the flat tube 10. Each fin unit 100 may be provided with a plurality of protrusions 130, and each protrusion 130 may be in a shape of a triangular prism extending along the thickness direction C of the flat tube 10. The plurality of protrusions 130 are arranged along the width direction B of the flat tube 10, and each protrusion 130 extends along the thickness direction C of the flat tube 10 and includes a first protrusion segment 131 and a second protrusion segment 132, in which the first protrusion segment 131 and the second protrusion segment 132 are spaced apart from each other along the thickness direction C of the flat tube 10. The drain hole 140 is located in a center of each fin unit 100 and between the first protrusion segment 131 and the second protrusion segment 132 in the thickness direction C of the flat tube 10.

As shown in FIG. 10, each fin unit 100 is provided with only the protrusion 130 at the portion thereof between the adjacent rows. Each fin unit 100 may be provided with a plurality of protrusions 130 arranged along the width direction B of the flat tube 10, each protrusion 130 may be in a shape of a triangular prism extending along the thickness direction C of the flat tube 10, and adjacent protrusions 130 are spaced apart from or connected with each other along the width direction B of the flat tube 10.

As shown in FIG. 11, each fin unit 100 is provided with only a plurality of louvers 150 at the portion thereof between the adjacent rows, each louver 150 extends along the thickness direction C of the flat tube 10, and the plurality of louvers 150 is arranged along the width direction B of the flat tube 10.

A heat exchanger according to an embodiment of the present disclosure is described in the following. The heat exchanger according to the embodiment of the present disclosure includes a first header, a second header and a heat exchanger coil.

The heat exchanger coil is the heat exchanger coil 1 according to the above embodiments of the present disclosure, a first end of each flat tube 10 of the heat exchanger coil 1 is connected to the first header, and a second end of each flat tube 10 of the heat exchanger coil 1 is connected to the second header.

The heat exchanger according to the embodiment of the present disclosure is provided with the heat exchanger coil 1 according to the above embodiments of the present disclosure, thus having a long frosting cycle and a high energy efficiency ratio.

Other configurations and operations of the heat exchanger according to the embodiment of the present disclosure are known to those skilled in the related art, which thus will not be described in detail herein.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A heat exchanger coil comprising:

a plurality of flat tubes, each flat tube having a length direction oriented along a vertical direction; and a plurality of fins, wherein each fin is disposed between adjacent flat tubes and comprises a plurality of fin units arranged along the length direction of the flat tube and sequentially connected into a corrugated shape, each fin unit has a windward end portion and a leeward end portion opposite to each other in a width direction of the flat tube, and at least one of the windward end portion and the leeward end portion of each fin unit extends beyond the plurality of flat tubes along the width direction of the flat tube and is provided with a drain hole, wherein the at least one of the windward end portion and the leeward end portion of each fin unit is further provided with a protrusion; and wherein the protrusion of each fin unit comprises a first protrusion segment and a second protrusion segment, and the drain hole is located between the first protrusion segment and the second protrusion segment in a thickness direction of the flat tube.

2. The heat exchanger coil as set forth in claim 1, wherein the windward end portion of each fin unit extends beyond the plurality of flat tubes along the width direction of the flat tube.

3. The heat exchanger coil as set forth in claim 1, wherein a plurality of protrusions is provided, each protrusion is in a shape of a triangular prism extending along the thickness direction of the flat tube, and adjacent protrusions are spaced apart from or connected with each other along the width direction of the flat tube.

4. The heat exchanger coil as set forth in claim 1, wherein the drain holes of the plurality of fin units are aligned with one another along the length direction of the flat tube, and each drain hole is a turn-up hole having a turn-up.

5. The heat exchanger coil as set forth in claim 4, wherein each flat tube has an upper end and a lower end in the length direction thereof, and the turn-up of each drain hole extends from the fin unit where the drain hole is towards the lower ends of the plurality of flat tubes.

6. The heat exchanger coil as set forth in claim 4, wherein each drain hole is a rectangular hole, the turn-up of each drain hole comprises a first turn-up segment and a second turn-up segment spaced apart from each other along the thickness direction of the flat tube and extending along the width direction of the flat tube.

7. The heat exchanger coil as set forth in claim 1, wherein a length of each of the at least one of the windward end portion and the leeward end portion along the width direction of the flat tube is represented by w2, and a maximum width of each protrusion along the width direction of the flat tube is represented by w3, and $0.05 \leq w3/w2 < 1$.

8. The heat exchanger coil as set forth in claim 1, wherein a length of each of the at least one of the windward end portion and the leeward end portion along the width direction of the flat tube is represented by w2, a width of each flat tube is represented by w1, and $0.05 \leq w2/w1 \leq 1.0$.

9. The heat exchanger coil as set forth in claim 1, wherein a length of each of the at least one of the windward end portion and the leeward end portion along the width direction of the flat tube is represented by w2, a width of each flat tube is represented by w1, a length of each fin unit along the width direction of the flat tube is represented by w, and $w \leq w1+w2 \leq 1.1w$.

10. The heat exchanger coil as set forth in claim 1, wherein a portion of each fin unit which does not extend beyond the plurality of flat tubes along the width direction of the flat tube is provided with a louver.

11. The heat exchanger coil as set forth in claim 10, wherein each fin unit is provided with a plurality of louvers spaced part from one another along the width direction of the flat tube, and lengths of the plurality of louvers along the thickness direction of the flat tube gradually decrease from a middle portion of each fin unit to the at least one of the windward end portion and the leeward end portion of each fin unit.

12. The heat exchanger coil as set forth in claim 10, wherein each fin unit is provided with a plurality of louvers arranged along the width direction of the flat tube, and the plurality of louvers of adjacent fin units are staggered with one another along the width direction of the flat tube.

13. The heat exchanger coil as set forth in claim 1, wherein the plurality of flat tubes are arranged in multiple rows spaced apart from one another along the width direction of the flat tube, the flat tubes in a row correspond to the flat tubes in an adjacent row one to one, each fin is disposed between adjacent flat tubes in each row, and the at least one of the windward end portion and the leeward end portion of each fin unit extends beyond the outermost ones of corresponding flat tubes in the multiple rows along the width direction of the flat tube.

14. The heat exchanger coil as set forth in claim 13, wherein each fin unit is provided with at least one of the protrusion, the drain hole and a louver at a portion thereof between adjacent rows.

15. A heat exchanger comprising:

a first header;

a second header; and a heat exchanger coil comprising:

a plurality of flat tubes, each flat tube having a length direction oriented along a vertical direction; and a plurality of fins, wherein each fin is disposed between adjacent flat tubes and comprises a plurality of fin units arranged along the length direction of the flat tube and sequentially connected into a corrugated shape, each fin unit has a windward end portion and a leeward end portion opposite to each other in a width direction of the flat tube, and at least one of the windward end portion and the leeward end portion of each fin unit extends beyond the plurality of flat tubes along the width direction of the flat tube and is provided with a drain hole, wherein the at least one of the windward end portion and the leeward end portion of each fin unit is further provided with a protrusion;

wherein the protrusion of each fin unit comprises a first protrusion segment and a second protrusion segment, and the drain hole is located between the first protrusion segment and the second protrusion segment in a thickness direction of the flat tube; and wherein a first end of each flat tube of the heat exchanger coil is connected to the first header, and a second end of each flat tube of the heat exchanger coil is connected to the second header.

* * * * *